US006880990B2

(12) United States Patent
Nishihata

(10) Patent No.: US 6,880,990 B2
(45) Date of Patent: Apr. 19, 2005

(54) THERMAL HEAD ENERGY CONTROL APPARATUS

(75) Inventor: Masahiro Nishihata, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 38 days.

(21) Appl. No.: 10/212,716

(22) Filed: Aug. 7, 2002

(65) Prior Publication Data

US 2003/0029337 A1 Feb. 13, 2003

(30) Foreign Application Priority Data

Aug. 8, 2001 (JP) ..... 2001-240162

(51) Int. Cl.[7] ..... B41J 2/315; B05C 17/06

(52) U.S. Cl. ..... 400/120.01; 101/128.21

(58) Field of Search ..... 400/120.01, 120.13, 400/120.14, 120.16, 120.17; 101/48, 50, 112, 114, 121, 125, 126, 127, 129, 128.21, 128.4; 347/193, 200, 201, 205; 428/365, 913

(56) References Cited

U.S. PATENT DOCUMENTS 5,415,090 A * 5/1995 Natori et al. ..... 101/128.21
5,534,909 A * 7/1996 Hanabusa et al. ..... 347/216
5,809,879 A * 9/1998 Yokoyama et al. ..... 101/128.4
5,924,360 A * 7/1999 Adachi et al. ..... 101/128.21
6,092,461 A * 7/2000 Tanaka et al. ..... 101/128.21
6,281,919 B1 * 8/2001 Okada ..... 347/172
6,317,149 B1 * 11/2001 Mochida et al. ..... 347/173
6,393,979 B1 * 5/2002 Tateishi ..... 101/128.21

* cited by examiner

*Primary Examiner*—Anjan Deb
*Assistant Examiner*—Hoai-An D. Nguyen
(74) *Attorney, Agent, or Firm*—Donald R. Studebaker; Nixon Peabody, LLP

(57) ABSTRACT

When perforating a stencil material by a thermal head on the basis of image data, the smoothness of the stencil material is measured. The energy applied to the thermal head is increased as the smoothness of the stencil material becomes lower.

7 Claims, 5 Drawing Sheets

THERMAL HEAD ENERGY CONTROL APPARATUS

BACKGROUND OF THE INVENTION

1. Field of the Invention

Figure 1:
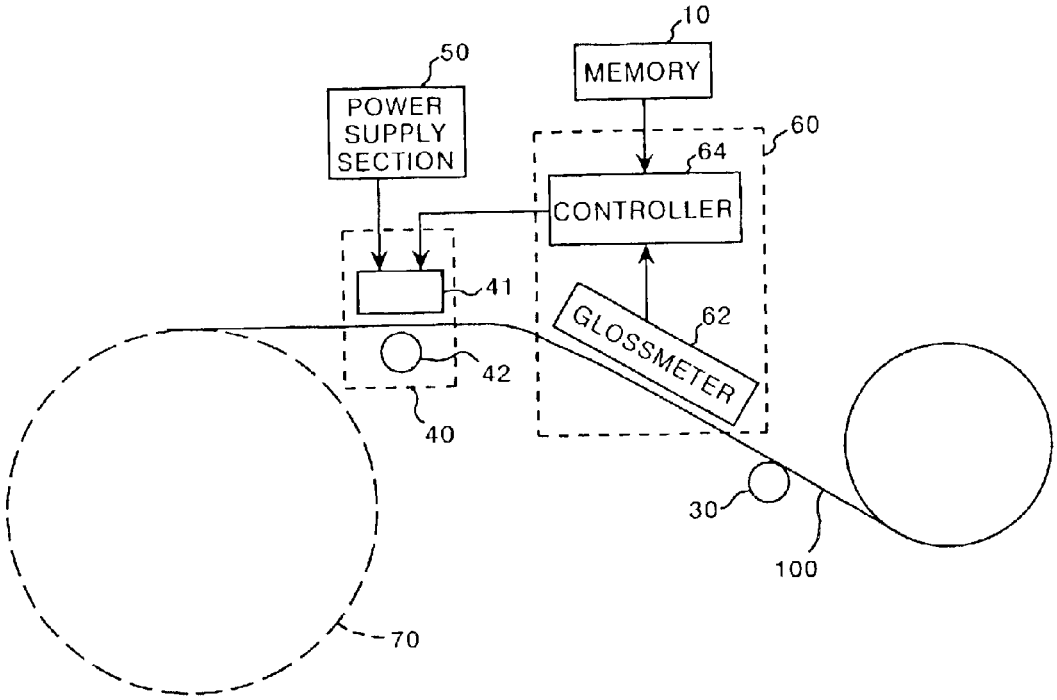

This invention relates to a thermal head energy control apparatus, and more particularly to an apparatus for controlling energy applied to a thermal head when a stencil material is perforated on the basis of image data representing an image.

2. Description of the Related Art

In a stencil printer, a stencil is first made by perforating a stencil material on the basis of image data, for instance, obtained by reading out an original or transferred from a computer. Then printings are obtained by transferring ink to a printing medium such as printing papers through the perforations in the stencil.

When the stencil material is perforated on the basis of image data, that is, the stencil is made, the stencil material is perforated by applying energy (thermal head energy) to the stencil material through a thermal head according to, for instance, the kind of the stencil material.

However, since the stencil material is kept rolled until it is unrolled to transfer an image thereto, the stencil material is locally wrinkled according to the time from the time the stencil material is produced to the time it is used, the force applied thereto when it is rolled or the pressure which the stencil material roll experiences. Especially, it has been well known that the outer and inner parts of the stencil material roll are greatly different from each other in smoothness.

Accordingly, when the same thermal head energy is applied to the stencil material irrespective of its part, defective perforation can occur due to difference in smoothness, which can result in deterioration in printing quality.

In order to overcome such a problem, there has been made an attempt to smooth the wrinkle of the stencil material by applying heat and pressure to the stencil material by heat rollers provided between the stencil material roll and the thermal head.

However, this approach has not been effective since it is difficult to find the intensity of heat and pressure to be applied to the stencil material.

SUMMARY OF THE INVENTION

In view of the foregoing observations and description, the primary object of the present invention is to provide a thermal head energy control apparatus which makes it feasible for a thermal head to perforate a stencil material without defective perforation irrespective of the smoothness of the stencil material.

In accordance with the present invention, there is provided a thermal head energy control apparatus for controlling energy applied to a thermal head when perforating a stencil material on the basis of image data comprising

- a measuring means which measures a characteristic value representing the smoothness of the stencil material, and
- an energy adjustment means which increases energy applied to the thermal head as the smoothness of the stencil material represented by the characteristic value measured by the measuring means becomes lower.

The "image data" means an image data representing an image to be printed and may be obtained through an image reader such as an image scanner or may be sent from a computer or the like.

The "characteristic value representing the smoothness of the stencil material" may be any characteristic value so long as it represents the smoothness of the stencil material. For example, the characteristic value may be the smoothness of the stencil material itself, the reflectance of the stencil material or the transmittance thereof.

It is preferred in view of the accuracy and simplicity in measurement that the characteristic value be the gloss and the measuring means optically measures the gloss of the stencil material. The "gloss" is defined in, for instance, JIS Z8741 (specular gloss measurement) and preferably the gloss as used here is that defined by specular gloss at 75° which is typically used for defining the gloss of paper.

The energy applied to the thermal head is, for instance, the product of the electric power applied to the thermal head per unit time and the time of application of the electric power to the thermal head. The energy adjustment means may change the energy applied to the thermal head by changing one or both of the electric power applied to the thermal head per unit time and the time of application of the electric power to the thermal head.

With the thermal head energy control apparatus of this embodiment, since the energy applied to the thermal head is increased as the smoothness of the stencil material lowers, the energy applied to the thermal head is increased when perforating, for instance, wrinkled part of the stencil material. Accordingly, even the wrinkled part of the stencil material roll, e.g., the inner part of the stencil material roll, can be successfully perforated without adding to the labor and time and without necessity of any additional space, whereby deterioration in efficiency of printing operation can be prevented.

When gloss is employed as the characteristic value representing the smoothness of the stencil material, the smoothness of the stencil material can be optically measured easily and accurately.

BREIF DESCRIPTION OF THE DRAWINGS

Figure 2:
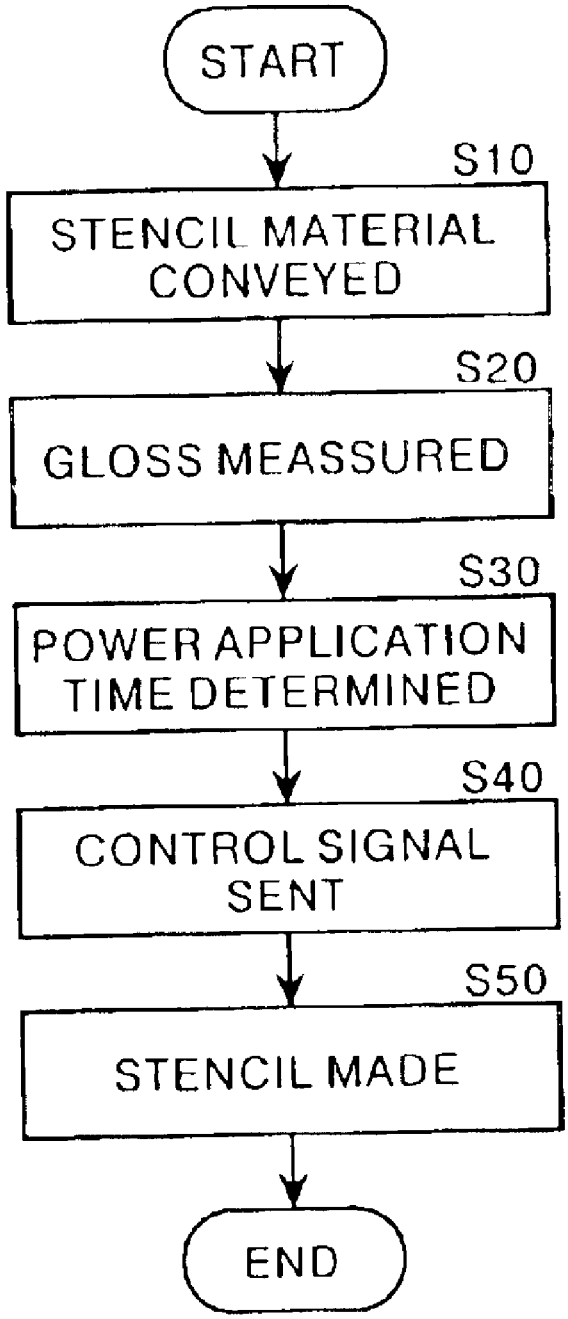
Figure 3:
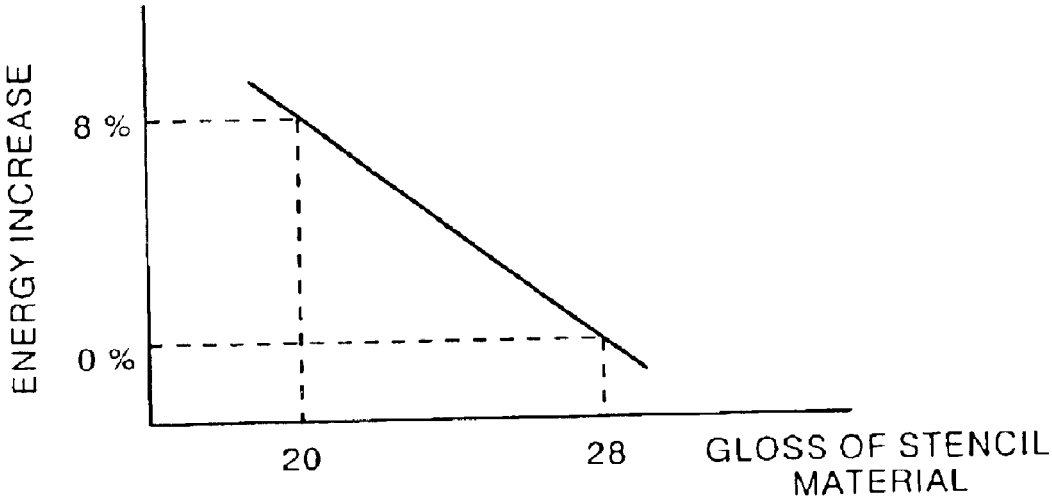
Figure 4:
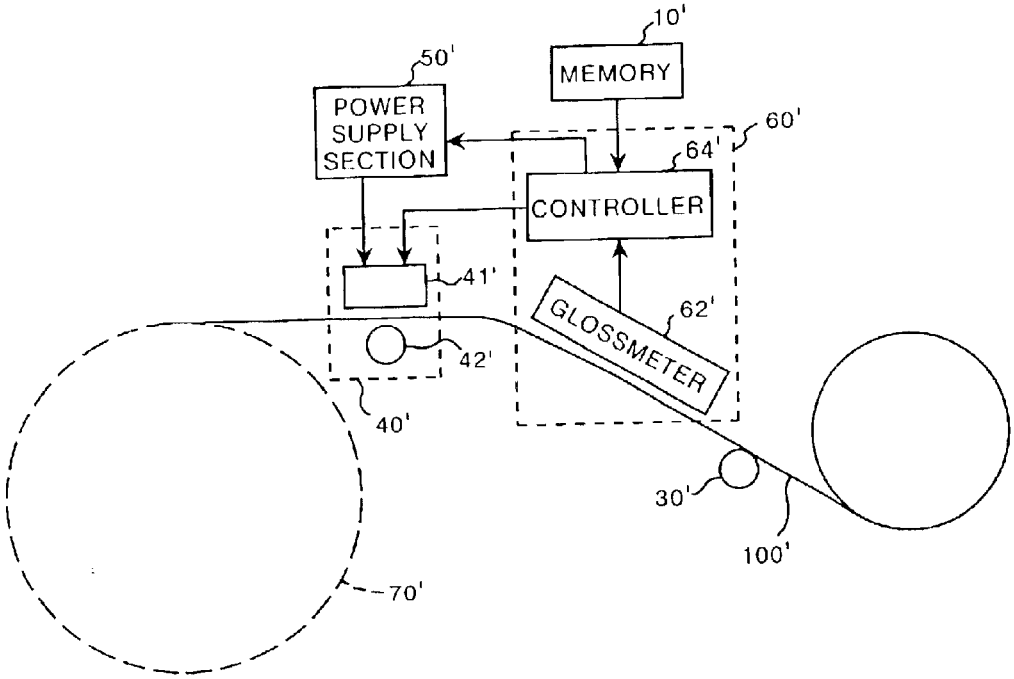
Figure 5:
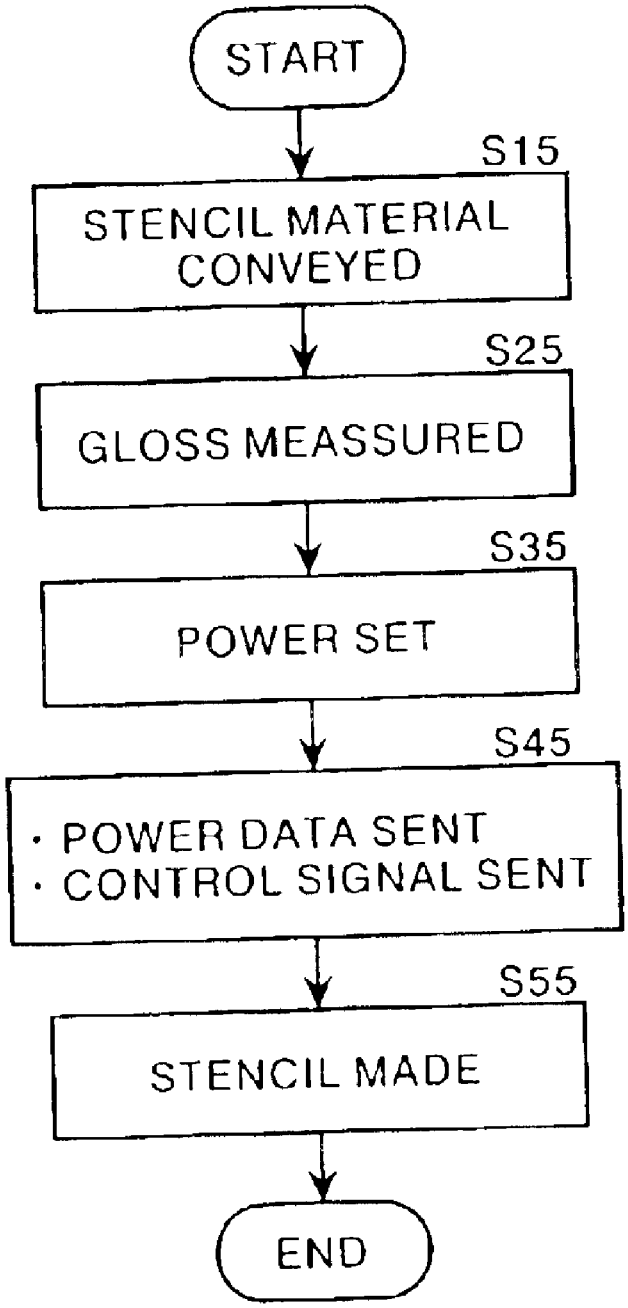

FIG. 1 is a block diagram showing a stencil making section of a stencil printer in which a thermal head energy control apparatus in accordance with a first embodiment of the present invention is employed, FIG. 2 is a flow chart for illustrating the operation of the stencil making section employed in the stencil printer shown in FIG. 1, FIG. 3 is a view showing an example of the relation between the gloss of the stencil material and the thermal head energy applied to the thermal head, FIG. 4 is a block diagram showing a stencil making section of a stencil printer in which a thermal head energy control apparatus in accordance with a second embodiment of the present invention is employed, and FIG. 5 is a flow chart for illustrating the operation of the stencil making section employed in the stencil printer shown in FIG. 4.

DESCRIPTION OF THE PREFERRED EMBODIMENTS

A stencil printer provided with a thermal head energy control section in accordance with a first embodiment of the present invention has a stencil making section shown in FIG. 1.

In FIG. 1, the stencil making section comprises a memory 10 which stores image data representing an image to be printed, a pair of conveyor rollers 20 which unroll a stencil material 100 from a stencil material roll and convey the stencil material 100, a guide roller 30, a thermal head 40 which image wise perforates the stencil material 100 on the basis of the image data stored in the memory 10, a power supply section 50 which supplies power to the thermal head 40, and a control section 60 which controls the power supply section 50.

The thermal head control section 60 further comprises a glossmeter 62 which measures the gloss of the stencil material immediately before it is perforated by the thermal head 40, and a controller 64 which outputs a control signal to the thermal head 40 for causing the thermal head to perforate the stencil material 100 on the basis of the image data stored in the memory 10. The controller 64 adjusts the time of application of electric power to the thermal head 40 according to the gloss of the stencil material 100 measured by the glossmeter 62, and sends a signal representing the adjusted time of application of electric power to the thermal head 40 in addition to the control signal.

The operation of the stencil making section will be described with reference to the flow chart shown in FIG. 2, hereinbelow. First the pair of conveyor rollers 20 start to convey the stencil material 100. (step S10) Before the stencil material 100 is perforated, the glossmeter 62 measures the gloss of the stencil material 100 immediately upstream of the thermal head 40 and sends the measured gloss of the stencil material 100 to the controller 64. (step S20) The controller 64 calculates necessary thermal head energy on the basis of the measured gloss of the stencil material 100 and determines the time of application of power to the thermal head 40 for given power applied to the thermal head 40 per unit time. (step S30) Then the controller 64 adds a signal representing the time of application of electric power to the control signal based on the image data stored in the memory 10 and sends them to the thermal head 40. (step S40)

FIG. 3 shows the relation between the gloss of the stencil material 100 and the thermal head energy necessary to perforate the stencil material 100. As can be understood from FIG. 3, as the gloss of the stencil material 100 lowers (the smoothness of the stencil material 100 lowers), larger energy is required to perforate the stencil material 100. That is, if the thermal head energy required to perforate the stencil material 100 when the gloss of the stencil material 100 is 28 is taken as 1, the thermal head energy required to perforate the stencil material 100 when the gloss of the stencil material 100 is 20 increases by 8%.

Though the thermal head energy can be changed by changing one or both of the electric power applied to the thermal head 40 per unit time and the time of application of the electric power to the thermal head 40, the thermal head energy is controlled by changing the time of application of the electric power with the electric power applied to the thermal head 40 per unit time fixed in this particular embodiment.

Then power supply section 50 supplies power to the thermal head 40 under the control of the control signal sent from the controller 64 for a time determined by the controller 64 according to the gloss of the stencil material 100, thereby perforating the stencil material 100. Thus a stencil (i.e., the stencil material 100 perforated on the basis of image data stored in the memory 10) is made. (step S50) The stencil thus made is wound around a printing drum 70 shown by the broken line in FIG. 1.

In this stencil making apparatus, since the time of application of the electric power to the thermal head 40 is changed according to the gloss of the stencil material 100, thereby adjusting the thermal head energy, the stencil material 100 is optimally perforated irrespective of its condition.

Though, in the first embodiment described above, the thermal head control section 60 changes the thermal head energy by changing the time of application of the electric power with the electric power applied to the thermal head 40 per unit time fixed, the thermal head may be changed by changing the electric power applied to the thermal head 40 per unit time with the time of application of the electric power fixed as in a second embodiment described below.

Figure is a flow chart for illustrating the operation of the thermal head energy control apparatus of the second embodiment.

First the pair of conveyor rollers 20' start to convey the stencil material 100'. (step S15) Before the stencil material 100' is perforated, the glossmeter 62' measures the gloss of the stencil material 100' immediately upstream of the thermal head 40' and sends the measured gloss of the stencil material 100' to the controller 64'. (step S25) The controller 64' calculates necessary thermal head energy on the basis of the measured gloss of the stencil material 100' and sets the power applied to the thermal head 40' per unit time with the time of application of power to the thermal head 40' fixed. (step S35) Then the controller 64' sends a signal representing the power thus set to the power supply section 50' and sends the control signal based on the image data stored in the memory 10 to the thermal head 40. (step S45) Then the power supply section 50' supplies power set by the control 64' according to the gloss of the stencil material 100' to the thermal head 40' under the control of the control signal sent from the controller 64' for a fixed time, thereby perforating the stencil material 100'. Thus a stencil (i.e., the stencil material 100' perforated on the basis of image data stored in the memory 10') is made. (step S55) The stencil thus made is wound around a printing drum 70' shown by the broken line in FIG. 4.

Though, in the embodiments described above, the gloss of the stencil material measured by a glossmeter is employed as the characteristic value representing the smoothness of the stencil material, the characteristic value may be any characteristic value so long as it represents the smoothness of the stencil material.

What is claimed is:

1. A thermal head energy control apparatus, comprising:

thermal head means for perforating a stencil material on the basis of image data;

a measuring means which measures a characteristic value representing the smoothness of the stencil material; and an energy adjustment means which increases energy applied to the thermal head as the smoothness of the stencil material represented by the characteristic value measured by the measuring means becomes lower.

2. A thermal head energy control apparatus as defined in claim 1 in which the characteristic value is the gloss of the stencil material and the measuring means optically measures the gloss of the stencil material.

3. A thermal head energy control apparatus as defined in claim 1 in which the energy adjustment means changes the energy applied to the thermal head by changing one or both of the electric power applied to the thermal head per unit time and the time of application of the electric power to the thermal head.

4. A method for controlling a thermal head for perforating a stencil material, comprising:

measuring a characteristic value representing the smoothness of the stencil material;

adjusting energy applied to the thermal head, wherein the energy applied increases as the smoothness of the stencil decreases; and perforating the stencil in accordance with the energy applied to the thermal head.

5. The method of claim 4, further comprising:

using image data to perforate the stencil.

6. The method of claim 4, wherein the characteristic value is a determined gloss of the stencil material.

7. The method of claim 4, wherein the adjusting energy further comprises:

changing the energy applied to the thermal head by changing at least one of the electric power applied to the thermal head per unit time and the time of application of electric power to the thermal head.

* * * * *